US008040259B2

(12) United States Patent
Glover

(10) Patent No.: US 8,040,259 B2
(45) Date of Patent: Oct. 18, 2011

(54) SYSTEMS AND METHODS FOR ALERTING TO TRAFFIC PROXIMITY IN THE AIRPORT ENVIRONMENT

(75) Inventor: Howard Glover, Yarrow Point, WA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 12/623,679

(22) Filed: Nov. 23, 2009

(65) Prior Publication Data

US 2011/0121998 A1 May 26, 2011

(51) Int. Cl.
*G08G 5/04* (2006.01)

(52) U.S. Cl. ..... 340/961; 701/301

(58) Field of Classification Search ..... 340/961, 340/933, 995.26; 701/9, 14, 301
See application file for complete search history.

(56) References Cited

U.S. PATENT DOCUMENTS

| | | | | |
|---|---|---|---|---|
| 4,978,945 | A | 12/1990 | Funatsu | |
| 6,744,396 | B2 * | 6/2004 | Stone et al. | 340/961 |
| 6,978,205 | B2 * | 12/2005 | Ryan et al. | 340/961 |
| 7,177,763 | B2 * | 2/2007 | Keber | 701/301 |
| 7,587,278 | B2 * | 9/2009 | Poe et al. | 701/301 |
| 7,765,037 | B2 * | 7/2010 | Bagge et al. | 340/961 |
| 7,808,377 | B2 * | 10/2010 | Shafaat et al. | 340/961 |
| 2002/0116127 | A1 * | 8/2002 | Sadler | 701/301 |
| 2006/0214816 | A1 * | 9/2006 | Schell | 340/961 |
| 2006/0265109 | A1 | 11/2006 | Canu-Chiesa et al. | |
| 2010/0017127 | A1 * | 1/2010 | Pepitone et al. | 701/301 |

* cited by examiner

*Primary Examiner* — John A Tweel, Jr.
(74) *Attorney, Agent, or Firm* — Lowe Graham Jones PLLC

(57) ABSTRACT

Systems and methods for alerting to traffic proximity in the airport environment. Knowledge of the geographic position, speed, rate of change of speed, heading (or track-angle) and/or altitude of own-aircraft (or vehicle) and another, potentially conflicting aircraft (or vehicle) are used to calculate a predicted distance between the two aircraft (or vehicles) at given point of time in the future. If separation distance is predicted to be less than a predetermined acceptable value, then an alert message (aural, visual or both) is issued to the pilot or operator of the vehicle.

17 Claims, 9 Drawing Sheets

SYSTEMS AND METHODS FOR ALERTING TO TRAFFIC PROXIMITY IN THE AIRPORT ENVIRONMENT

GOVERNMENT INTEREST

The invention described herein was made in the performance of work under FAA Agreement #DTFAWA-09-00001. The Government may have rights to portions of this invention.

BACKGROUND OF THE INVENTION

Several collision accidents have occurred at airports where an aircraft or vehicle has entered a runway environment which is already occupied by another aircraft that is moving at significant speed. Airborne collision protection and mitigation is provided by Traffic Collision and Avoidance System (TCAS), however the algorithms used in TCAS systems are not well suited to the airport surface operations problem; on airports, near runways, aircraft commonly operate at relatively high speeds in close proximity to other aircraft and vehicles. For example, an aircraft waiting to enter a runway is commonly stopped within a distance of the order of 100 feet from a runway that may be occupied by a landing aircraft traveling at speeds greater than 100 knots, thereby confusing TCAS algorithms. Also, on the ground at normal taxi speeds, an airplane can change its direction of travel much more rapidly than can an airborne aircraft.

SUMMARY OF THE INVENTION

The present invention uses knowledge of the geographic position, speed, rate of change of speed, heading (or track-angle) and/or altitude of own-aircraft (or vehicle) and another, potentially conflicting aircraft (or vehicle) to calculate the predicted distance between the two aircraft (or vehicles) at given point of time in the future. If separation distance is predicted to be less than a predetermined acceptable value, then an alert message (aural, visual or both) is issued to the pilot or operator of the vehicle. The required information from the potentially conflicting traffic is obtained over a data communication channel, such as Automatic Dependent Surveillance-Broadcast (ADS-B), Automatic Dependent Surveillance-Rebroadcast (ADS-R) or Traffic Information Service-Broadcast (TISB) data. The information required from own-aircraft is readily available from on-board systems such as Global Positioning Systems and Air Data Systems.

BRIEF DESCRIPTION OF THE DRAWINGS

Preferred and alternative embodiments of the present invention are described in detail below with reference to the following drawings.

DETAILED DESCRIPTION OF THE INVENTION

Figure 1:
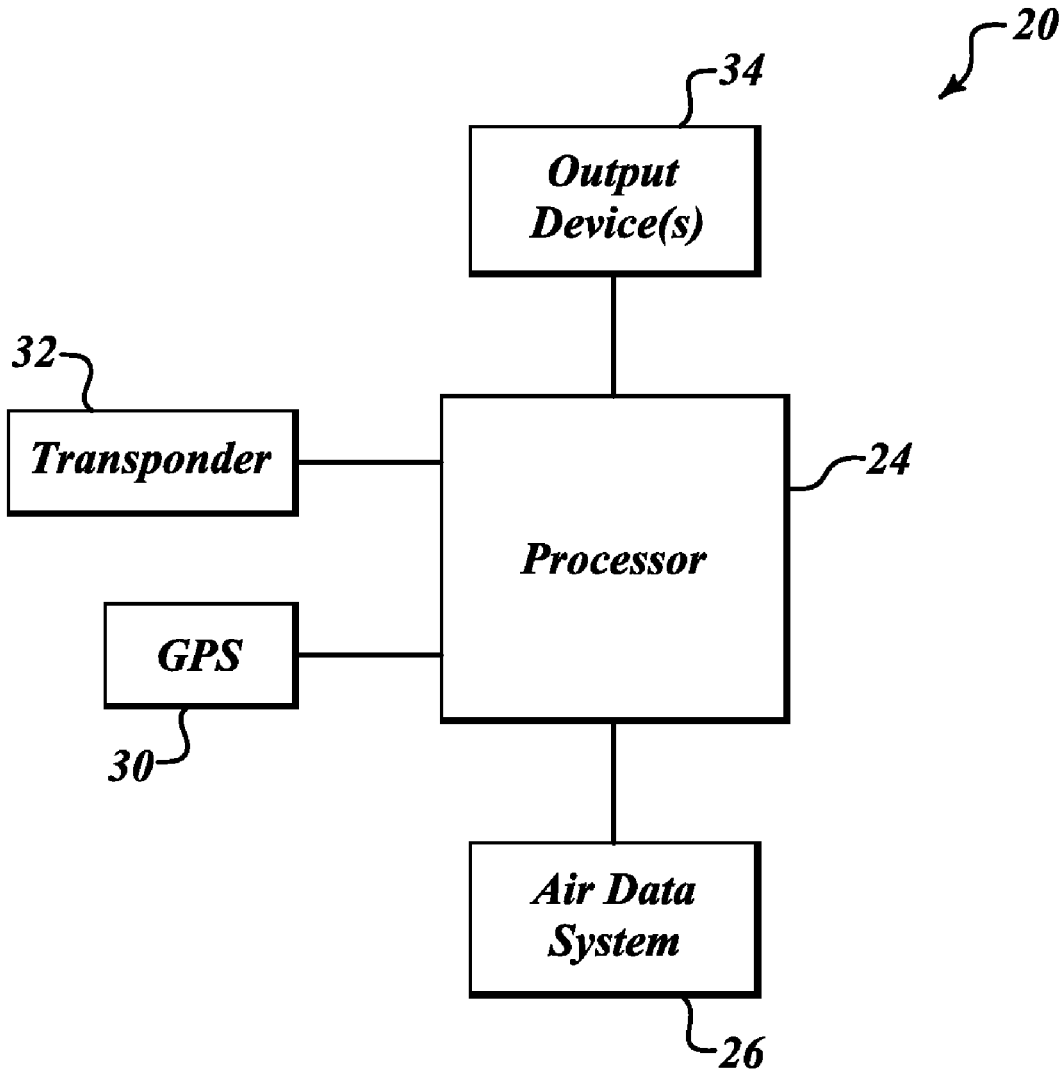
FIG. 1 illustrates a schematic diagram of an example system for performing traffic proximity alerting in the airport environment in accordance with an embodiment of the present invention.

FIG. 1 shows an example vehicle collision alerting system 20 for providing warning and/or caution alerts to vehicle operators if ground based trajectories of own and other vehicles might lead to a collision. The system 20 includes a processor 24, an air data system (ADS) 26, a position determining device (e.g. global positioning system (GPS) 30), a transponder 32 and one or more output device 34.

The processor 24 sends and receives state information over a data channel via the transponder 32. Using own-vehicle information (from the GPS 30 and the ADS 26) and target vehicle state information (position, velocity, acceleration and track-angle), the processor 24 calculates predicted range between the two vehicles for a set of future times. If the predicted range is less than a pre-determined "allowable miss distance" at a time less than Tw, then a Warning alert is generated and outputted to one of the output device(s) 34. If the predicted range is less than the "allowable miss distance" at a time less than Tc, then a Caution alert is generated and outputted to one of the output device(s) 34.

The processor 24 provides predictions for many scenarios—i.e. for converging runway traffic as well as same runway traffic. However, to avoid missed alerts when either own-vehicle or the target vehicle is changing track-angle rapidly—which happens on the ground—the predicted positions are calculated at a set of future times—e.g. every three seconds out to 30 seconds, i.e. 10 calculations. This frequency can vary. Also, the accelerations (rate of change of speed) of own-vehicle and target vehicle are used to provide more accurate predictions. Acceleration of the target vehicle is calculated from reported velocity (or geographic position), and filtered to reduce noise.

In another embodiment, the processor 24 uses track-angle data from own-vehicle and traffic vehicle to calculate track-angle rate to improve the prediction of position when own-vehicle and/or target vehicle is turning. Since the relative positions of the own-vehicle and the traffic vehicle are known, the direction from which the target vehicle is converging is also calculated, and the direction can be included in the alert message: e.g. "Traffic left", or "Traffic 9 o'clock".

Figure 2:
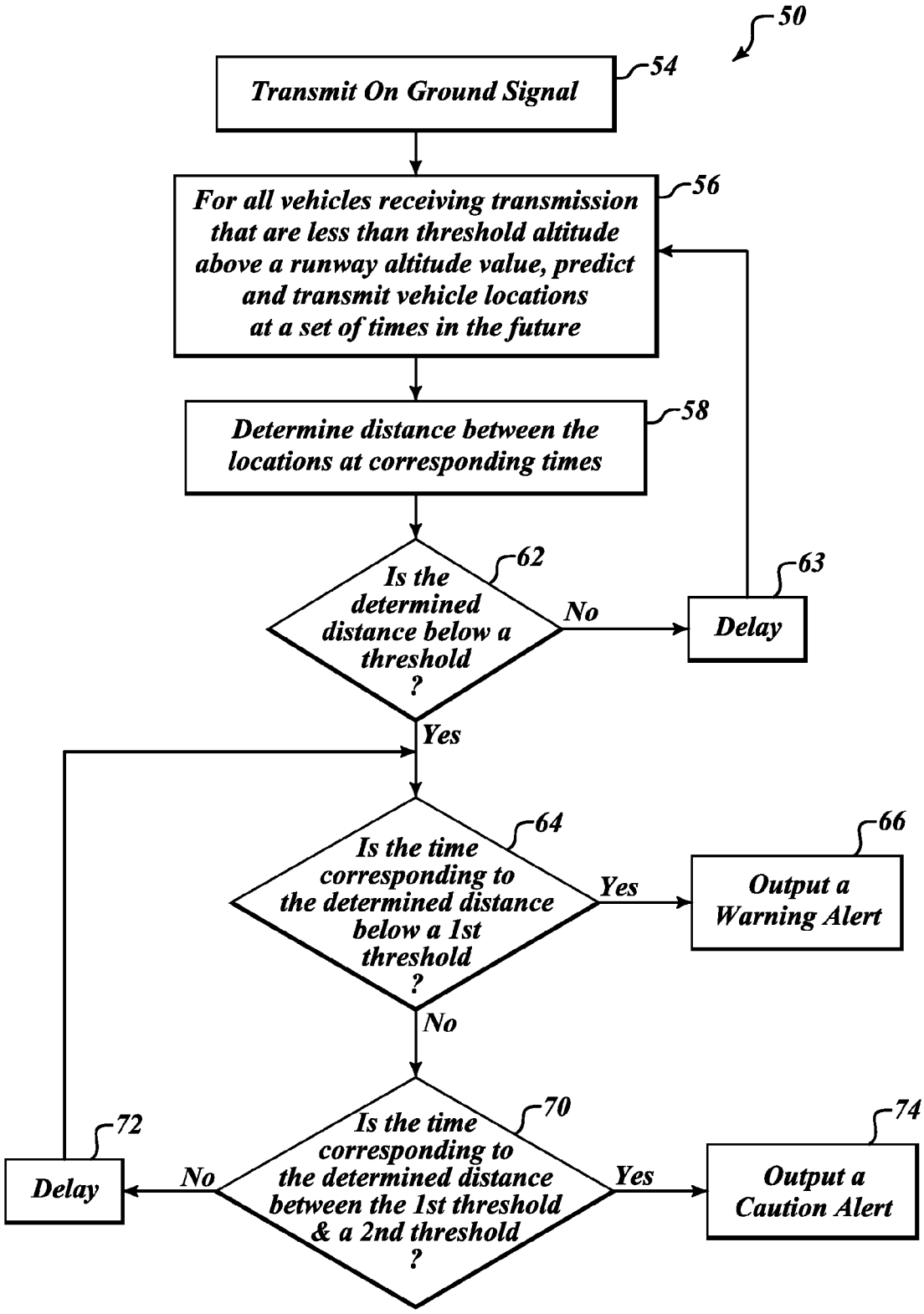
FIG. 2 illustrates a flow diagram for performing traffic proximity alerting in the airport environment using the system shown in FIG. 1.

FIG. 2 illustrates an example process 50 performed by the system 20 shown in FIG. 1. When a vehicle (e.g. aircraft, ground crew vehicle) is on the ground, a ground signal is transmitted over a data communication channel, see block 54. Next at block 56, for all vehicles receiving the ground signal transmission that are less than threshold altitude above an associated runway altitude value, locations at a set of times in the future of the vehicle receiving the ground signal transmission and vehicle transmitting the ground signal are predicted. Then at block 58, distance between the locations at corresponding times are determined.

At a decision block 62, the processor 24 determines if one of the determined distances between corresponding times is below a predefined threshold. If one of the determined distances is below the threshold, then at decision block 64, the processor 24 determines if the time corresponding to the determined distance is below a first time threshold. If the corresponding time is below the first time threshold, the system 20 outputs a warning alert, see block 66. If none of the determined distances are below the predefined threshold, the process 50 is delayed at block 63 and returned to block 56.

If the corresponding time is not below the first time threshold, then at decision block 70, the processor 24 determines if the time corresponding to the determined distance is between the first time threshold and a second time threshold. If the corresponding time is not between the first and second time threshold, the process 50 is delayed at block 72 then returned to decision block 64. If the corresponding time is between the first and second time threshold, the system 20 outputs a caution alert at block 74.

Figure 3:
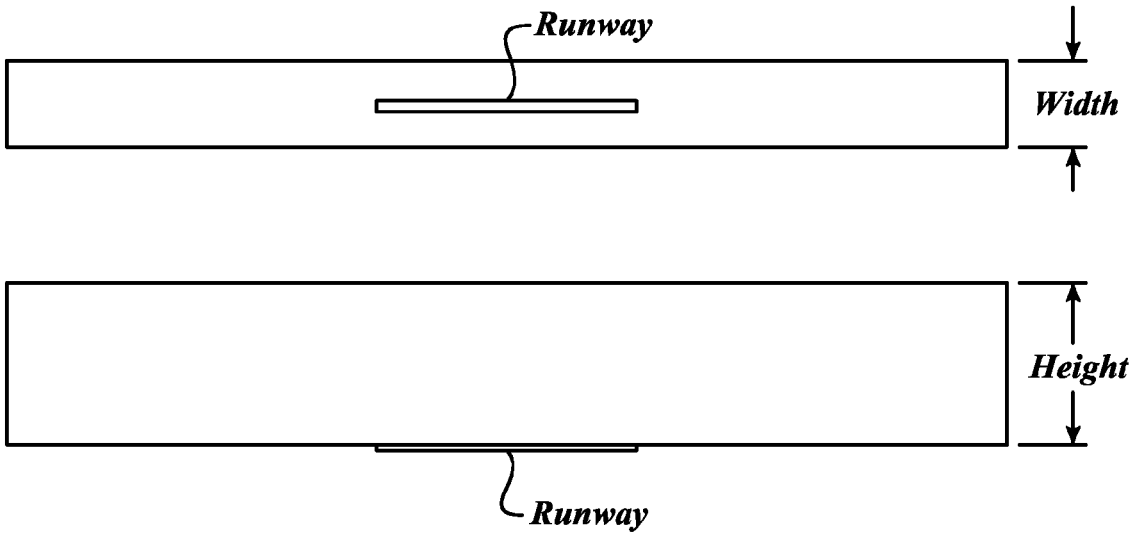
FIG. 3 illustrates runway proximity zone used by the present invention.

FIG. 3 illustrates an example of runway proximity zone, which defines the volume of interest around a runway. A primary condition for triggering an alert is that both "ownship" and a traffic target must be in the proximity zone. In one embodiment, the width of the zone increases if the velocity component of ownship or target towards the runway is above a predefined value(s).

Figure 4:
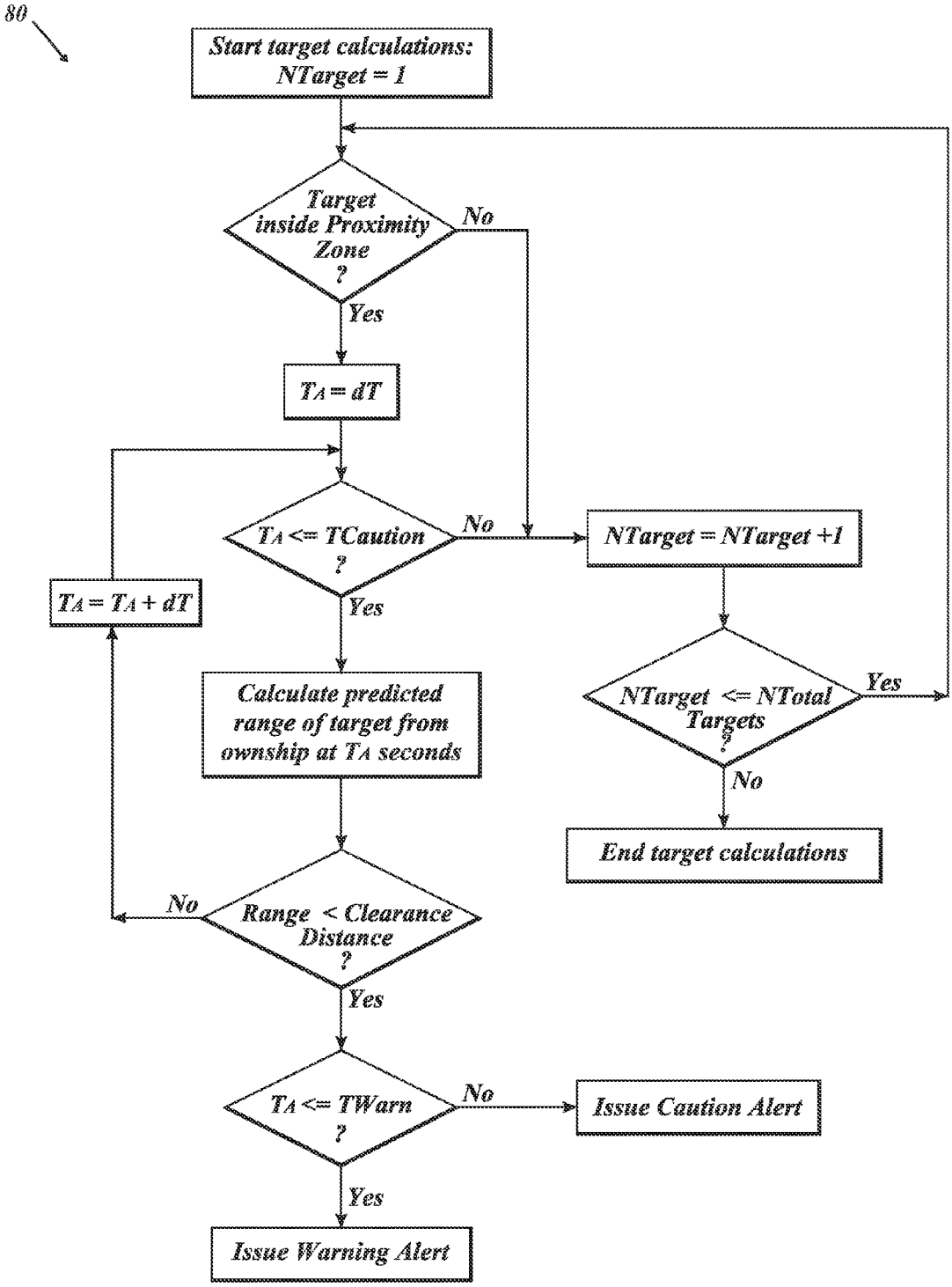
FIG. 4 is a flow diagram of an example process for testing alerting status of traffic.

FIG. 4 is a flowchart of an example process 80 for testing alert status of a traffic target. If the target aircraft/vehicle is within the proximity zone, $T_A$ is made equal to the time interval between calculations (dT—e.g., 1 second). $T_A$ varies between dT and TCaution in steps of dT. If $T_A$ is less than or equal to TCaution, then range of target from ownship is predicted at $T_A$ seconds. In one embodiment, TCaution is ~30 seconds and TWarn is ~15 seconds. If the predicted range is greater than a predefined clearance distance, the process 80 increments $T_A$ by dT and repeats the analysis. If the predicted range is less than the predefined clearance distance, the process 80 outputs a warning alert if $T_A$ is greater than a predefined TWarn, otherwise caution alert is outputted. A warning alert may include a visual symbol (e.g., red icon) or an aural message (e.g., "Traffic Ahead"). A tactile alert may also be outputted.

If $T_A$ is not less than or equal to TCaution or the target is not inside the proximity zone, then the process 80 proceeds to analyze the next target aircraft/vehicle based on observed ADS-B traffic targets.

Figure 5A:
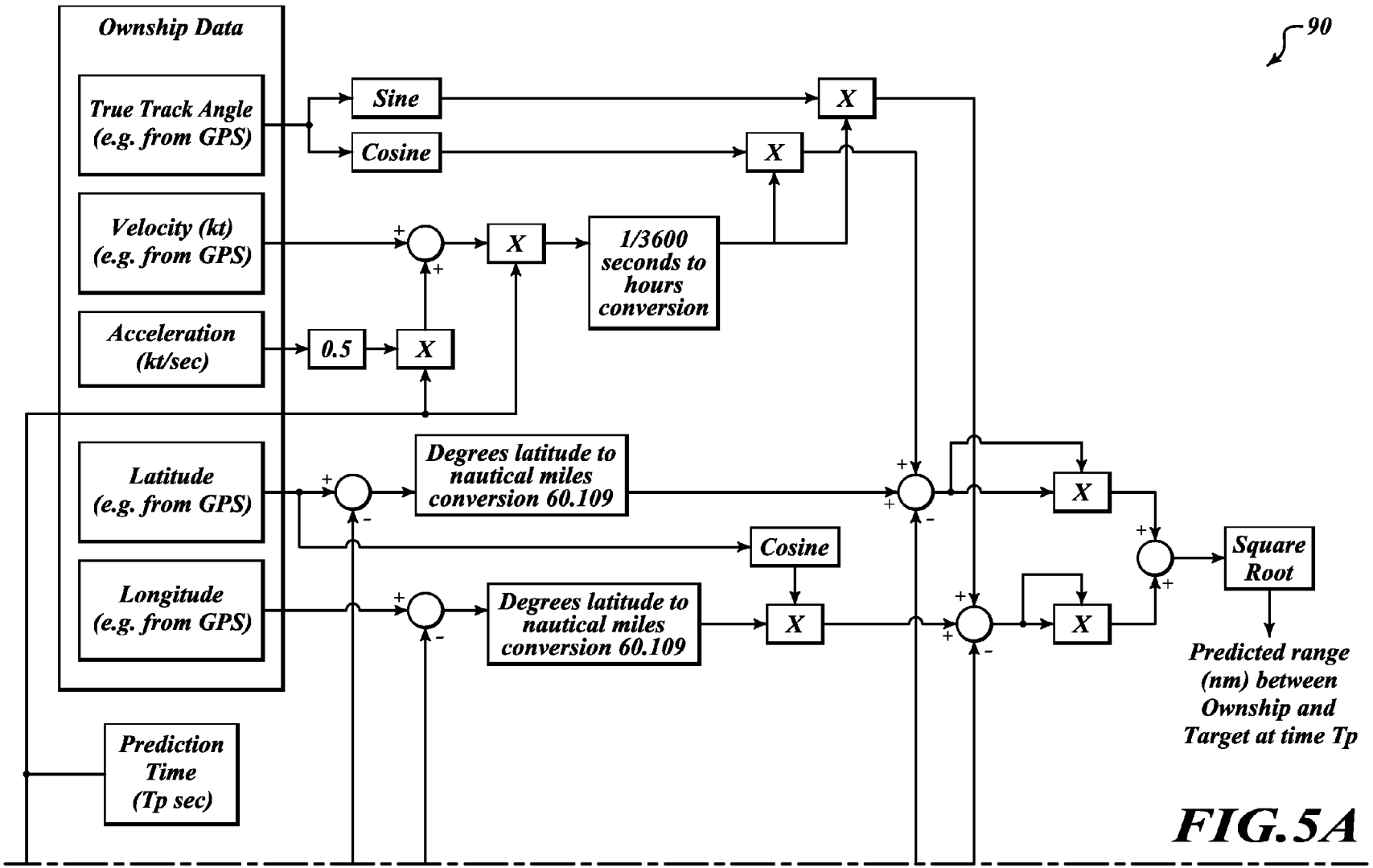
FIGS. 5A and B a flowchart of an example process used to calculate the predicted separation distance between ownship and the target at a future time.
Figure 5B:
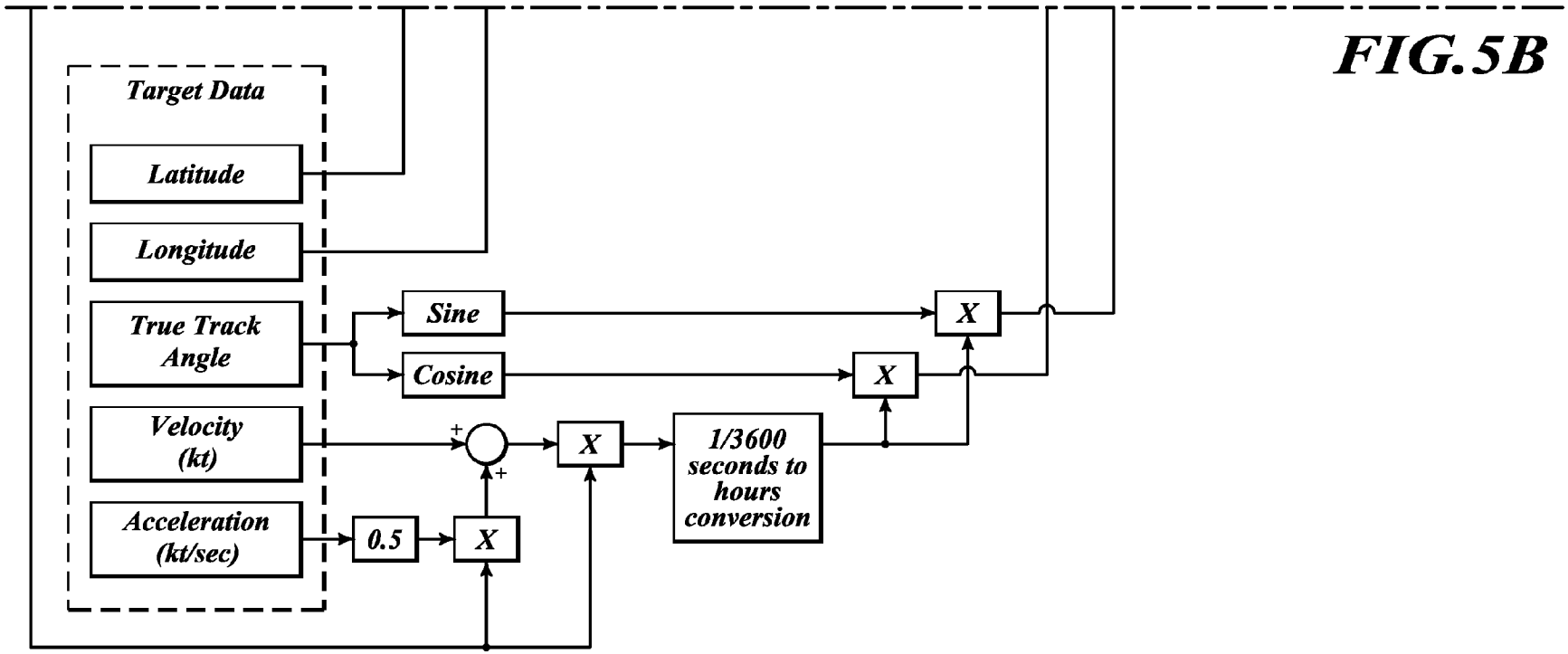

FIGS. 5A and B illustrate a flowchart of an example process 90 used to calculate the predicted separation distance between ownship and the target at a future time. $T_P$ is the same as $T_A$. The average accelerations (rate of change of forward velocity) of ownship and traffic targets are calculated using the following algorithm. The algorithm averages the acceleration value over N samples, where N is typically of the order of 10.

$$AvgAccel_K = \sum_{i=0}^{N-1} (V_{K-i} - V_{k-i-1})/dT$$

Where $AvgAccel_K$ is the average acceleration in the $K^{th}$ time interval, N is the number of averaging samples, $V_{K-i}$ is the velocity at the $i^{th}$ sample before the current time interval, $V_{K-i-1}$ is the velocity at the $(i-1)^{th}$ sample before the current time interval, and dT is the time step used in the calculations (typically 1 second).

Figure 6:
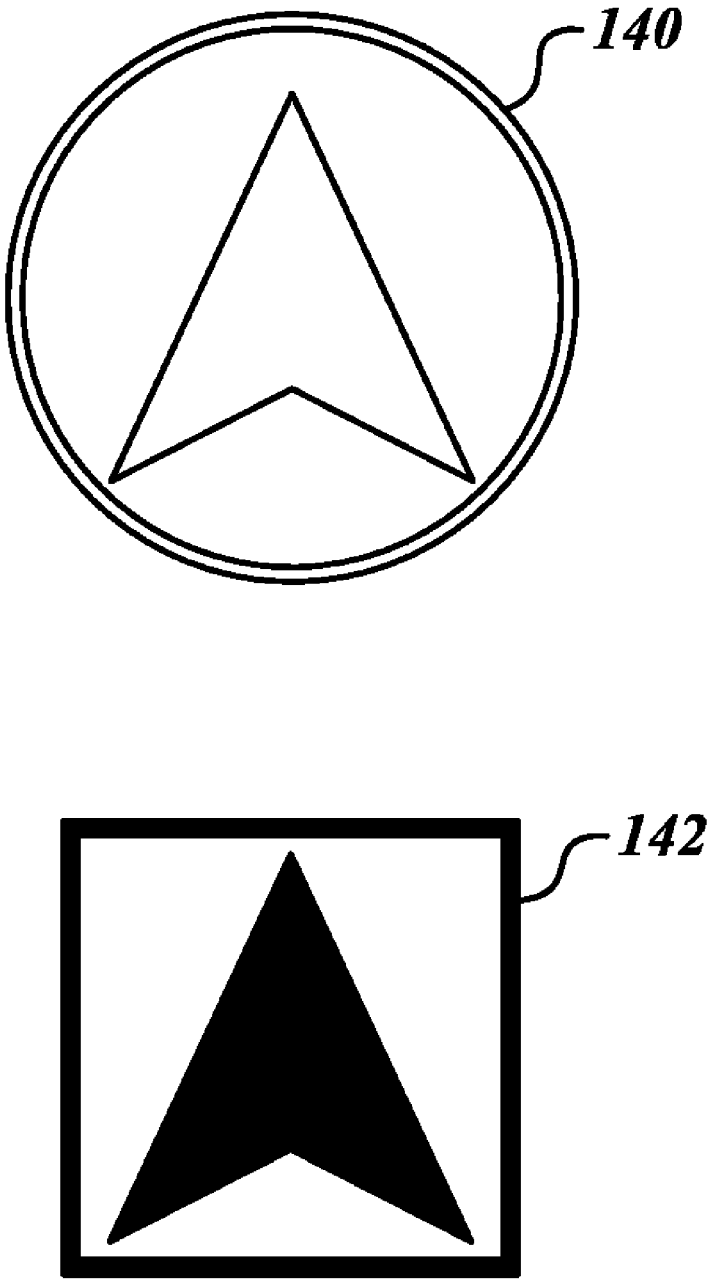
FIG. 6 illustrates caution and warning target icons presented on a display of a host vehicle.

FIG. 6 illustrate icons 140 and 142 that are presented on an own aircraft display in plan view for representing any target aircraft/vehicles. The first icon 140 includes a triangular vehicle symbol inside a circular perimeter that is presented when a vehicle associated with the first icon 140 has triggered a caution alert. In one embodiment, the first icon 140 is presented as a distinct color (e.g., yellow). The second icon 142 includes a triangular vehicle symbol inside a square perimeter that is presented when a vehicle associated with the second icon 142 has triggered a warning alert. In one embodiment, the second icon 142 is presented as a distinct color (e.g., red). Relevant and proximate traffic would be displayed without the encompassing circle/square and would not be displayed in the distinct color—yellow or red.

Figure 7:
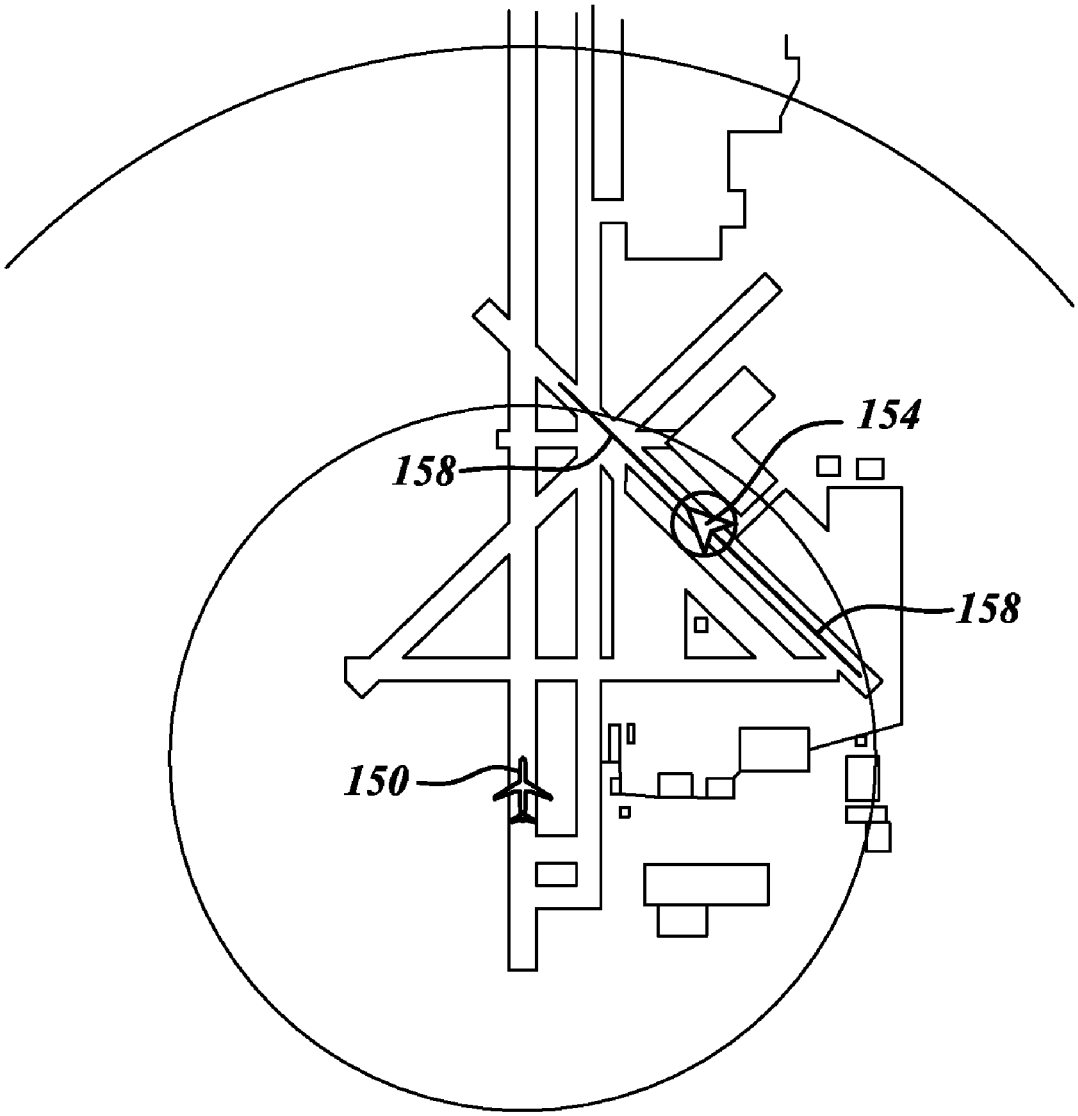
FIGS. 7 and 8 illustrate plan views of an airport area displaying caution and warnings in accordance with embodiments of the present invention.

FIG. 7 illustrates a plan view radar display with the own aircraft 150 center in circular range circles. In this situation, the alerting system on the own aircraft 150 has received a ground signal from a target aircraft associated with the aircraft icon 154 and determined that the target meets the criteria of a caution alert. Thus, the aircraft icon 154 appears similar to icon 140 as shown in FIG. 6. Also, a line 158 that extends along the direction of travel from the icon 154 is presented on the display. The line 158 is determined based on status information received from the target aircraft. The line 158 is presented in the same color as the icon 154.

Figure 8:
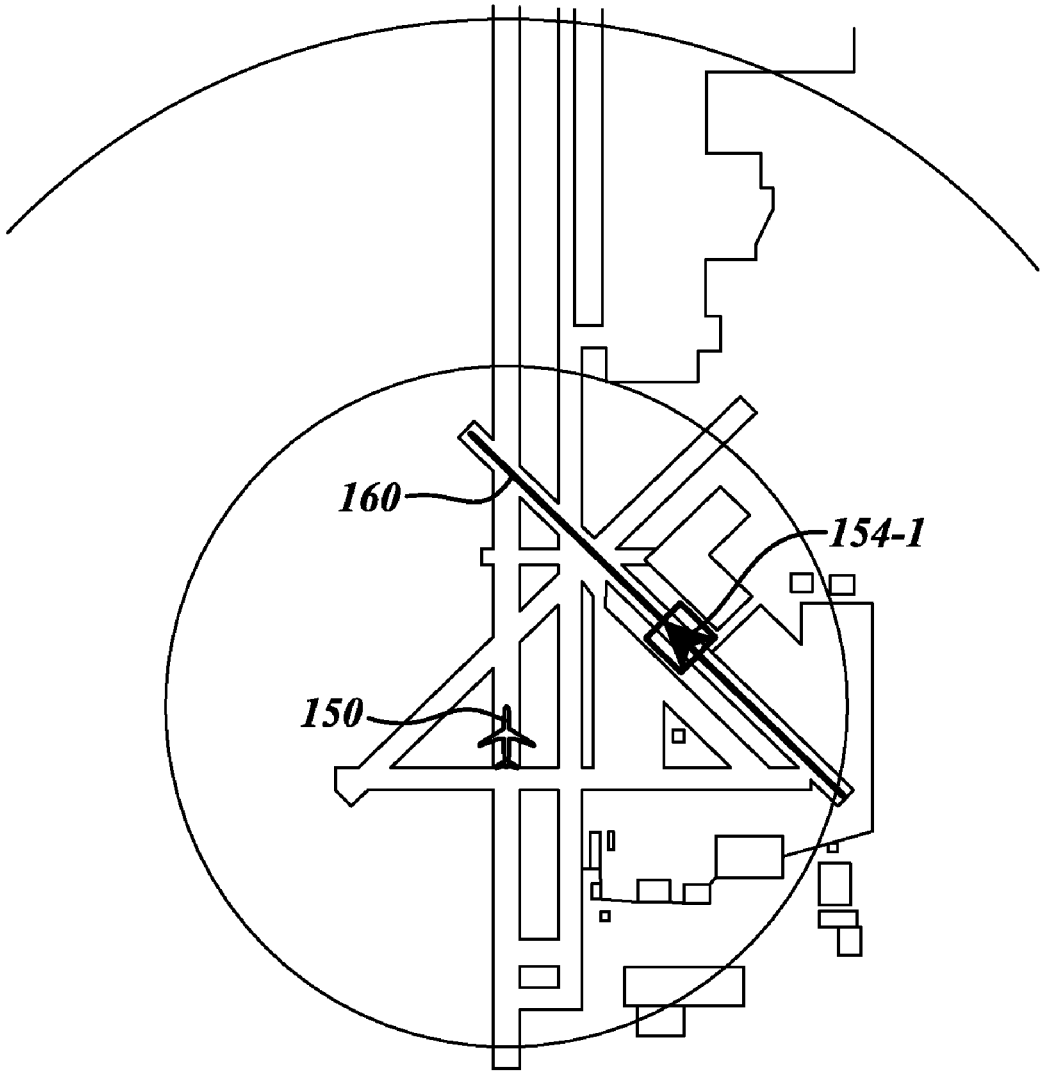

FIG. 8 illustrates a situation where the alerting system on the own aircraft 150 has received a ground signal from a target aircraft associated with an aircraft icon 154-1 and determined that the target meets the criteria of a warning alert. Thus, the aircraft icon 154-1 appears similar to icon 142 as shown in FIG. 6. Also, a line 160 that extends along the direction of travel from the icon 154-1 is presented on the display. The line 150 is determined based on status information received from the target aircraft as described above. The line 150 is presented in the same color as the icon 154-1.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A method comprising:

a) receiving at a first vehicle a ground signal and state information from a second vehicle;

b) if altitude of the first vehicle is below a threshold value, predicting at the first vehicle locations of the first vehicle and the second vehicle for two or more future times;

c) outputting a warning alert, if distance between at least one of a pair of the predicted locations is below a threshold distance and the corresponding future time is below a first time threshold; and d) outputting a caution alert, if distance between at least one of a pair of the predicted locations is below the threshold distance and the corresponding future time is between the first time threshold and a second time threshold.

2. The method of claim 1, further comprising repeating b-d) after a predefined delay, if distance between at least one of a pair of the predicted locations is not below the threshold distance.

3. The method of claim 2, further comprising repeating c-d) after a predefined delay, if distance between at least one of a pair of the predicted locations is below the threshold distance and the corresponding future time is not below the first time threshold and not between the first time threshold and a second time threshold.

4. The method of claim 1, wherein predicting comprises determining an acceleration value for the second vehicle and predicting according to the determined acceleration value.

5. The method of claim 1, wherein predicting comprises determining an acceleration value for the first vehicle and predicting according to the determined acceleration value.

6. The method of claim 1, wherein predicting comprises determining a track-angle rate based on track-angle data of the first vehicle and track-angle data received from the second vehicle and predicting according to the determined track-angle rate.

7. The method of claim 1, further comprising:

determining at the first vehicle relative direction from which the second vehicle is converging; and outputting a traffic location message based on the convergence determination.

8. The method of claim 7, wherein the outputted traffic location message is outputted with the warning and caution alerts.

9. A system on a vehicle comprising:

a receiver configured to receive a ground signal and state information from a second vehicle;

an output device; and a processor in signal communication with the receiver and the output device, the processor comprising:

a first component configured to predict at the first vehicle locations of the first vehicle and the second vehicle for two or more future times, if altitude of the first vehicle is below a threshold value;

a second component configured to send a warning alert to the output device, if distance between at least one of a pair of the predicted locations is below a threshold distance and the corresponding future time is below a first time threshold; and a third component configured to send a caution alert to the output device, if distance between at least one of a pair of the predicted locations is below the threshold distance and the corresponding future time is between the first time threshold and a second time threshold.

10. The system of claim 9, wherein the first-third components repeat after a predefined delay if distance between at least one of a pair of the predicted locations is not below the threshold distance.

11. The system of claim 10, wherein the second and third components repeat after a predefined delay, if distance between at least one of a pair of the predicted locations is below the threshold distance and the corresponding future time is not below the first time threshold and not between the first time threshold and a second time threshold.

12. The system of claim 9, wherein the first component determines an acceleration value for the second vehicle and predicts according to the determined acceleration value.

13. The system of claim 9, wherein the first component determines an acceleration value for the first vehicle and predicts according to the determined acceleration value.

14. The system of claim 9, wherein the first component determines a track-angle rate based on track-angle data of the first vehicle and track-angle data received from the second vehicle and predicts according to the determined track-angle rate.

15. The system of claim 9, wherein the processor further comprises:

a fourth component configured to determine at the first vehicle relative direction from which the second vehicle is converging; and a fifth component configured to output a traffic location message to the output device based on the convergence determination.

16. The system of claim 15, wherein the output device outputs the traffic location message with the warning and caution alerts.

17. A system comprising:

a means for receiving at a first vehicle a ground signal and state information from a second vehicle;

a means for predicting at the first vehicle locations of the first vehicle and the second vehicle for two or more future times, if altitude of the first vehicle is below a threshold value;

a means for outputting a warning alert, if distance between at least one of a pair of the predicted locations is below a threshold distance and the corresponding future time is below a first time threshold; and a means for outputting a caution alert, if distance between at least one of a pair of the predicted locations is below the threshold distance and the corresponding future time is between the first time threshold and a second time threshold.

* * * * *